US006315599B1

(12) United States Patent
Daoud

(10) Patent No.: US 6,315,599 B1
(45) Date of Patent: Nov. 13, 2001

(54) STRAIN RELIEF MECHANISM FOR INSULATION DISPLACEMENT CONNECTOR

(75) Inventor: Bassel Hage Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/103,332

(22) Filed: Jun. 23, 1998

(51) Int. Cl.[7] ..... H01R 13/58
(52) U.S. Cl. ..... 439/459
(58) Field of Search ..... 439/459, 456, 439/596, 417

(56) References Cited

U.S. PATENT DOCUMENTS 3,336,565 * 8/1967 Crimmins ..... 439/459
4,913,659 * 4/1990 Doyle ..... 439/395
5,741,147 * 4/1998 Konoya et al. ..... 439/459

* cited by examiner

*Primary Examiner*—Gary Paumen
(74) *Attorney, Agent, or Firm*—Stroock & Stroock & Lavan LLP

(57) ABSTRACT

A strain relief for a wire inserted through the cap of an insulation displacement connector including a tab hingeably mounted on the connector for selective movement between an unlocked position and a locked position. When the tab is in the unlocked position, the tab receives the wire after the wire passes through the connector, and when the tab is in the locked position, a restraining force is applied to the wire thereby inhibiting the removal of the wire from the connector.

15 Claims, 2 Drawing Sheets

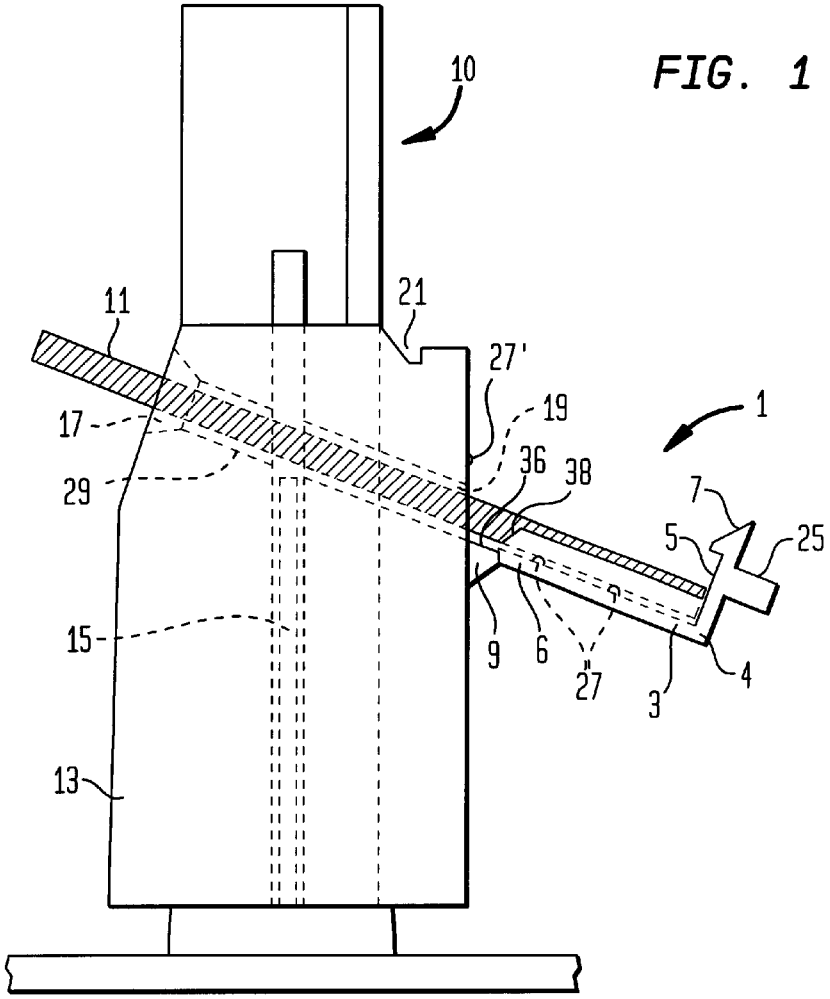
FIG. 1
FIG. 3
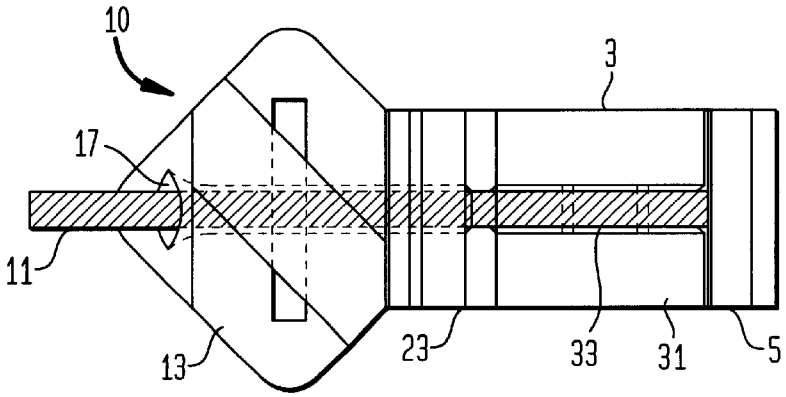

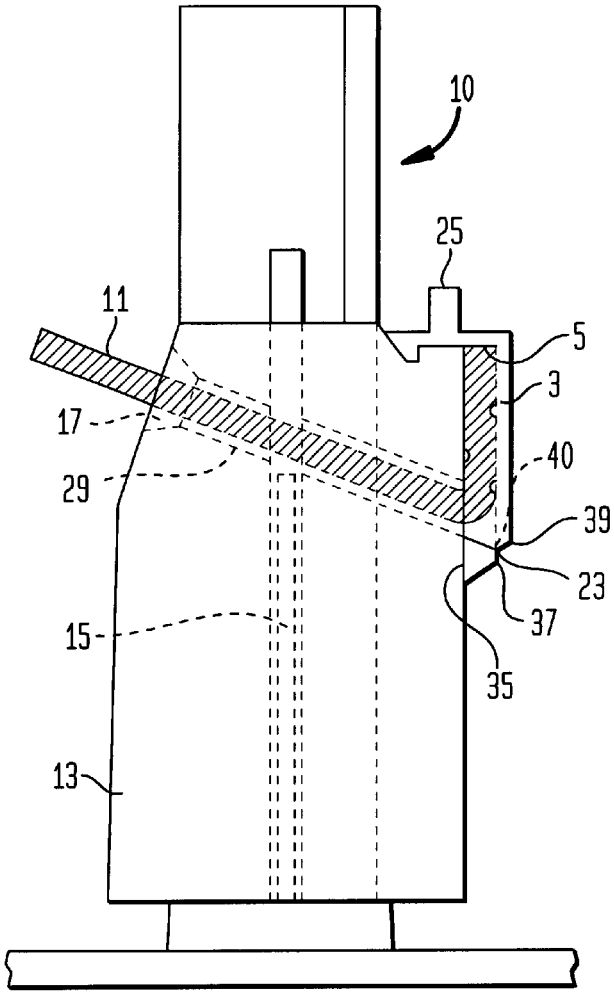
FIG. 2
FIG. 4
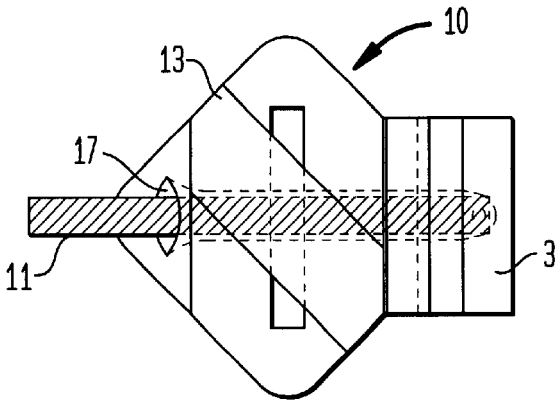

STRAIN RELIEF MECHANISM FOR INSULATION DISPLACEMENT CONNECTOR

FIELD OF THE INVENTION

This invention relates to a tool-less insulation displacement connector having a cap, and in particular to a wire strain relief mechanism attached to the cap for inhibiting the removal of wires connected to the insulation displacement connector.

BACKGROUND OF THE INVENTION

Telephone lines, which are carried by electrical conductors known as tip ring wire pairs, originate from a central office (CO) and are aggregated at a particular point in a building prior to being distributed and connected to various types of telephone equipment, such as, for example, telephones, fax machines, modems etc., in the building. The tip ring wire pairs, which generally enter the building as part of a multi-conductor cable, are connected to a junction box known as, for example, a building entrance protector (BEP), or network interface unit (NIU). Within the junction box, the individual telephone line tip ring wire pairs are separated from the cable, individually connected to a connector block, and made available for further electrical connection and distribution.

The connector block, also known as insulation displacement connector (IDC) block, may be the ubiquitous punch down connector block, also known as a 66-type connector block, or the tool-less insulation displacement connector block utilizing push cap connectors, such as that described in U.S. Pat. No. 4,913,659 dated Apr. 3, 1990, the entire disclosure of which is incorporated herein by reference. Such a connector block is commercially available under the product designation SC99 from Lucent Technologies Inc.

The tool-less insulation displacement connector block includes an IDC type connector on one side of the connector block having a terminal disposed therein for connecting a tip ring wire thereto. Opposite each IDC connector on the other side of the connector block is a matching, electrically connected wire wrap terminal, such that a wire connected on the wire wrap side may be connected to another wire coupled to the IDC side of the block. The tip and ring wires that are coupled to the IDC connector are strain relieved by the compression of the terminal within the IDC that holds the bare wire which has been stripped of its insulation layer.

A significant drawback of the prior art IDC connectors is that the terminal in the connector provides minimal strain relief on the inserted tip ring wire. As a result, when a pulling force is applied to the tip or ring wire, the wire can be dislodged from the terminal and disconnected from the connector.

Another drawback encountered in prior art IDC connectors is the need to trim excess wire that protrudes through and beyond the cap once the wire is secured within the IDC. These trimmings are generally short, difficult to handle wire lengths that can easily fall into the BEP or NIU or other associated equipment, posing the risk of causing short circuits or other malfunctions.

Thus, it is desirable to provide a better strain relief mechanism for wires connected to an IDC connector in a connector block to prevent the tip ring wires from being disconnected from the connector in response to a pulling force, and to eliminate hazardous wire trimmings.

SUMMARY OF THE INVENTION

The present invention is directed at overcoming the shortcomings of the prior art. The present invention is directed to a mechanism for providing strain relief for a wire inserted through a connector and includes a tab hingeably mounted on the connector for selective movement between an unlocked position and a locked position. When the tab is in the unlocked position, the tab receives the wire after the wire passes through the connector, and when the tab is in the locked position, a restraining force is applied to the wire thereby inhibiting the removal of the wire from the connector. Also, a plurality of ribs may be disposed on the tab and connector in a position so that when the tab is in the locked position the ribs contact the wire thereby applying an additional restraining force to the wire. In this way, there is provided strain relief for the wire inserted through the connector thereby inhibiting the removal of the wire from the connector.

Additionally, the tab includes a provision for limiting the length of wire that protrudes from the cap, thereby eliminating the need for trimming errant wire ends.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWING FIGURES

In the drawing figures, which are not to scale, and which are merely illustrative, and wherein like reference numerals depict like elements throughout the several views:

FIG. 1 is a side elevational view of a tool-less wire strain relief mechanism constructed in accordance to the present invention;

FIG. 2 is a side elevational view of the tool-less wire strain relief mechanism of FIG. 1 in the closed position;

FIG. 3 is a top view of the tool-less wire strain relief mechanism of FIG. 1; and FIG. 4 is a top of the tool-less wire strain relief mechanism of FIG. 2.

DETAILED DESCRIPTION OF THE PREFERRED EMBODIMENTS

Referring now to FIGS. 1–4, there is shown a tool-less wire strain relief mechanism 1 constructed in accordance to the present invention. Strain relief mechanism 1 includes a tab 3 which is hingeably mounted on a cap 13 of an IDC connector 10. Tab 3 includes a surface 31, preferably having formed thereon a channel 33 for receiving a wire 11 which—as part of the process of inserting wire 11 into connector 10 for electrical and mechanical connection to a terminal strip 15 within connector 10—is passed into cap 13 through an entrance aperture 17, passes within and through cap 13 in a wire passage 29, and exits through an exit aperture 19. Upon exit, wire 11 then extends beyond cap 13 for a predetermined extent along tab 3, within channel 33 if so provided. As used herein the term wire means any elongated conductor, insulated or non-insulated, commonly encountered in the electrical and/or electronic arts.

A stop wall 5 is disposed on a first end 4 of tab 3 for limiting the extend to which wire 11 extends beyond cap 13 within channel 33 as the wire 11 is passed through cap 13 as described above. A latch 7 is disposed on the top portion of stop wall 5 for locking tab 3 against cap 13 in a locked position, described further below, via mating engagement with a notch 21 formed on a side surface of cap 13. Protruding from the opposite side of stop wall 5 is a knob 25 used for gripping tab 3 and moving tab 3 between a first, unlocked position (FIGS. 1 and 3) and a second, locked position (FIGS. 2 and 4).

Within channel 33 there are preferably, although not necessarily, disposed a plurality of ribs 27. Also preferably disposed on cap 13 is one or more ribs 27'. Ribs 27 and 27' are dimensioned and positioned so that when tab 3 is in a locked position, ribs 27 and 27' contact wire 11 for assisting in the retention of wire 11 in channel 33, as described in more detail below.

A second end 6 of tab 3 includes an upper edge surface 38 and a lower edge surface 39. Upper edge 38 and lower edge 39 preferably have respective slopes so that they converge generally at a point 40 on second end 6 of tab 3. Second end 6 of tab 3 is connected to a hinge support 9 via a hinge 23. As cap 13 is preferably formed of a plastic material, hinge 23 is preferably a living hinge, permitting cap 13 to be injected molded in one manufacturing step. The person of skill, however, will recognize that the present invention may implemented in numerous ways, such, as for example, with tab 3 being a separate assembly, removeably or fixedly mounted to cap 13.

Referring now to FIGS. 1 and 2, hinge support 9 is preferably trapezoidal in shape, having a wide surface 35 that is fixedly attached to or formed on cap 13 at a point that is below wire exit aperture 19 so that when tab 3 is in the unlocked position, channel 33 of tab 3 is substantially collinear with wire passage 29 within cap 13. Hinge support 9 also has a narrow edge surface 37 that is adjacent to tab 3. Narrow edge 37 is dimensioned and shaped so that when tab 3 is in the unlocked position, lower edge surface 39 of tab 3 contacts narrow edge surface 37 of hinge support 9, thereby supporting tab 3 and preventing the further rotation of tab 3 in a direction away from cap 13. In this way, the alignment of channel 33 and passage 29 is maintained when the tab 3 is in the first, unlocked position.

Disposed on hinge support 9 at a point intermediate narrow edge 37 and wide edge 35, and adjacent wire output 19, is a sloped edge 36. Sloped edge 36 is dimensioned and shaped so that when tab 13 is in the locked position, upper edge 38 generally confronts sloped edge 36. Of course, other geometries of tab 3 and hinge support 9 are possible, as a matter of design choice.

Hinge 23 connects point 40 of tab 3 to the point on hinge support 9 where narrow edge 37 meets sloped edge 36. As mentioned above, in a preferred embodiment, hinge 23 is a living hinge but may be a hinge of any type that facilitates the rotation of tab 3 between the locked and unlocked positions, as further described below.

The operation of strain relief mechanism 1 will now be described. Initially, as best seen in FIGS. 1 and 3, tab 3 is in the unlocked position, in which channel 33 of tab 3 is in substantially collinear alignment with wire passage 29. Tab 3 is supported in this alignment by hinge support 9, which prevents the further rotation of tab 3 away from cap 13. Wire 11 is inserted into wire passage 29 of cap 13 through wire input aperture 17 and is urged through wire passage 29, and out through wire exit aperture 19. Upon exiting wire exit aperture 19, wire 11 enters channel 33 and continues until it contacts stop wall 5 at which point wire 11 is fully inserted in tab 3. Knob 25 is then gripped and tab 3 is rotated from the unlocked position toward cap 13 to the locked position, bending wire 11. In the locked position, latch 7 mates with notch 21 thereby securing tab 3 to cap 13. No trimming of the portion of wire 11 that extends beyond cap 13 is needed. Of course the person of skill will recognize that numerous other means of releasably retaining the tab in the locked provision may be provided, such as for example a snaps, mating detents and protrusions, clips, and the like.

When cap 13 is in the locked position, the section of wire 11 disposed within cap 13 in passage 29, and the section of wire 11 that is disposed in channel 33 of tab 3 are no longer collinear. The bending of wire 11 brought about by the rotation of tab 3 into the locked position strain relieves wire 11, in that removing wire 11 from connector 10 when bent requires a greater force than that necessary to overcome the gripping force applied by the terminal strip 15 within connector 10, which gripping force was the sole retaining force in prior art IDC connectors.

Also, when in the locked position, and if so provided, ribs 27 disposed on tab 3 and ribs 27' disposed on cap 13 press into wire 11, thereby providing additional restraining force on wire 11 to further inhibit the removal of wire 11 from connector 10. Accordingly, by providing strain relief mechanism 1 of the present invention, wire 11 is better secured within connector 10 so that wire 11 will not be easily dislodged from connector 10 by a pulling force applied to wire 11.

The person of skill will recognize that the wire 11 is preferably passed through cap 13 and locked via tab 3 prior to the wire 11 being brought into engagement with terminal strip 15 in connector 10. However, the wire 11 may first be positioned as shown in FIGS. 1 and 3 in accordance with the description thereof above, then brought into engagement with terminal strip 15 in the art recognized manner. Tab 3 may then being brought into the locked position. The point at which the wire is strain relieved by the present invention is a matter of choice, that is, the wire may thus be strain relieved before contacting the terminal strip or after, without departing from the scope of the invention.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. An insulation displacement connector cap and strain relief, comprising:

a tab hingeably mounted on said cap for selective movement between a first position and a second position, said cap having a wire entrance aperture on a first side of said cap, and a wire exit aperture on a second side of said cap, said cap further having a terminal strip and a terminal strip channel, said terminal strip and said terminal strip channel being disposed between said first and said second sides of said cap, said tab comprising a wire receiving surface, said wire receiving surface being sized and shaped for receiving a portion of a wire exiting from said wire exit aperture and extending beyond said cap in a first orientation when said tab is in said first position, said wire portion being moved by said wire receiving surface of said tab into a second orientation that is out of alignment with said first orientation as said tab is moved into said second position, the misalignment between said first orientation and said second orientation resulting in said wire being strain relieved.

2. The strain relief of claim 1, wherein said tab has a first end removed from said cap, said tab further comprising a stop wall disposed on said first end for limiting an extent to which said wire extends beyond said cap upon exit therefrom.

3. The strain relief of claim 1, wherein said tab has a latch disposed thereon and said cap has a notch disposed thereon such that when said tab is in said second position, said latch mates with said notch for securing said tab to said cap in said second position.

4. The strain relief of claim 1, wherein said tab is hingeably mounted to said connector by a living hinge.

5. The strain relief of claim 1, further comprising a hinge support disposed on said cap at a point below which said wire exits said connector, said hinge support having an abutment surface adjacent said tab when said tab is in said first position for inhibiting the movement of said tab in any direction other than toward said second position.

6. The strain relief of claim 1, wherein a first rib is disposed on said tab and a second rib is disposed on said cap such that when said tab is in said second position said first rib and said second rib contact said wire and apply a restraining force to said wire for providing further strain relief.

7. The strain relief of claim 1, wherein said tab further comprises a channel formed in said wire receiving surface for guidedly receiving said wire.

8. The strain relief of claim 1, wherein said tab is integrally formed on said cap.

9. The strain relief of claim 8, wherein said cap and said integral tab are unitarily formed by injection molding.

10. The strain relief of claim 9, wherein said tab is hingeably mounted to said cap by a living hinge.

11. The strain relief of claim 1, wherein said cap is deployed on an insulation displacement connector that is one of an array of insulation displacement connectors mounted on a connector block.

12. A strain relief and cap of an insulation displacement connector, said cap having a wire entrance aperture on a first side of said cap, and a wire exit aperture on a second side of said cap, said cap further having a terminal strip and a terminal strip channel, said terminal strip and said terminal strip channel being disposed between said first and said second sides of said cap, the strain relief comprising a tab connected by a hinge to said cap at a point below said wire exit aperture, said tab having a wire receiving surface, said wire receiving surface being sized and shaped for receiving a wire portion, said tab being moveable between a first position for receiving said wire portion on said wire receiving surface, and a second position wherein said wire portion is retained between said cap and said tab such that said wire is strain relieved.

13. The strain relief of claim 12, wherein a first rib is disposed on said tab and a second rib is disposed on said cap such that when said tab is in said second position said first rib and said second rib press against and apply a restraining force to said wire for providing further strain relief.

14. The strain relief of claim 12, firther comprising means for releasably retaining said tab in said second position.

15. The strain relief of claim 12, wherein said cap is deployed on an insulation displacement connector that is one of an array of insulation displacement connectors mounted on a connector block.

* * * * *